US006568061B2

(12) United States Patent
Hanusiak et al.

(10) Patent No.: US 6,568,061 B2
(45) Date of Patent: May 27, 2003

(54) METHOD FOR CONTROLLING COMPOSITE PREFORM ELEMENTS DURING PROCESSING

(75) Inventors: William Hanusiak, Candia, NH (US); Lisa Hanusiak, Candia, NH (US); Jeffery Parnell, Chelmsford, MA (US); Charles Rowe, Derry, NH (US); Steven Spear, Derry, NH (US)

(73) Assignee: Atlantic Research Corporation, Gainesville, VA (US)

( * ) Notice: Subject to any disclaimer, the term of this patent is extended or adjusted under 35 U.S.C. 154(b) by 0 days.

(21) Appl. No.: 09/957,630

(22) Filed: Sep. 21, 2001

(65) Prior Publication Data

US 2003/0056355 A1 Mar. 27, 2003

(51) Int. Cl.[7] ..... B23P 17/00
(52) U.S. Cl. ..... 29/423; 29/419.1; 420/129
(58) Field of Search ..... 29/419.1, 423, 29/452; 139/35, 420 A, 420 R, 425 R; 148/407, 516; 428/608; 420/129

(56) References Cited

U.S. PATENT DOCUMENTS 3,571,901 A * 3/1971 Sara ..... 164/80
3,596,344 A * 8/1971 Kreider ..... 29/213.1
3,606,667 A * 9/1971 Kreider ..... 164/46
3,615,277 A * 10/1971 Kreider et al. ..... 228/124.6
4,562,951 A * 1/1986 Cytron ..... 148/403
4,761,206 A * 8/1988 Forrest ..... 205/50
4,867,644 A * 9/1989 Wright et al. ..... 416/230
4,919,594 A * 4/1990 Wright et al. ..... 29/527.5
5,104,460 A * 4/1992 Smith et al. ..... 148/407
5,180,409 A * 1/1993 Fischer ..... 139/408
5,440,806 A * 8/1995 Wei et al. ..... 29/419.1
5,454,403 A * 10/1995 Kerr et al. ..... 139/35
5,763,079 A * 6/1998 Hanusiak et al. ..... 156/188
5,933,703 A * 8/1999 Robertson ..... 428/549

* cited by examiner

*Primary Examiner*—Gregory Vidovich
*Assistant Examiner*—Essama Omgba
(74) *Attorney, Agent, or Firm*—Nixon & Vanderhye, P.C.; Frank P. Presta

(57) ABSTRACT

A method of retaining composite preforms in the nature of fiber/metal matrix composites in position during processing, comprising the steps of positioning a predetermined assembly of fibers and metal matrix on a mandrel. The metal matrix may be in the form of wires, powder or foil. A retaining wire of a suitable heat resistant metal, such as titanium is spirally wound under tension over the fiber/metal matrix assembly to retain the assembly in a predetermined position on the mandrel during subsequent processing.

11 Claims, 3 Drawing Sheets

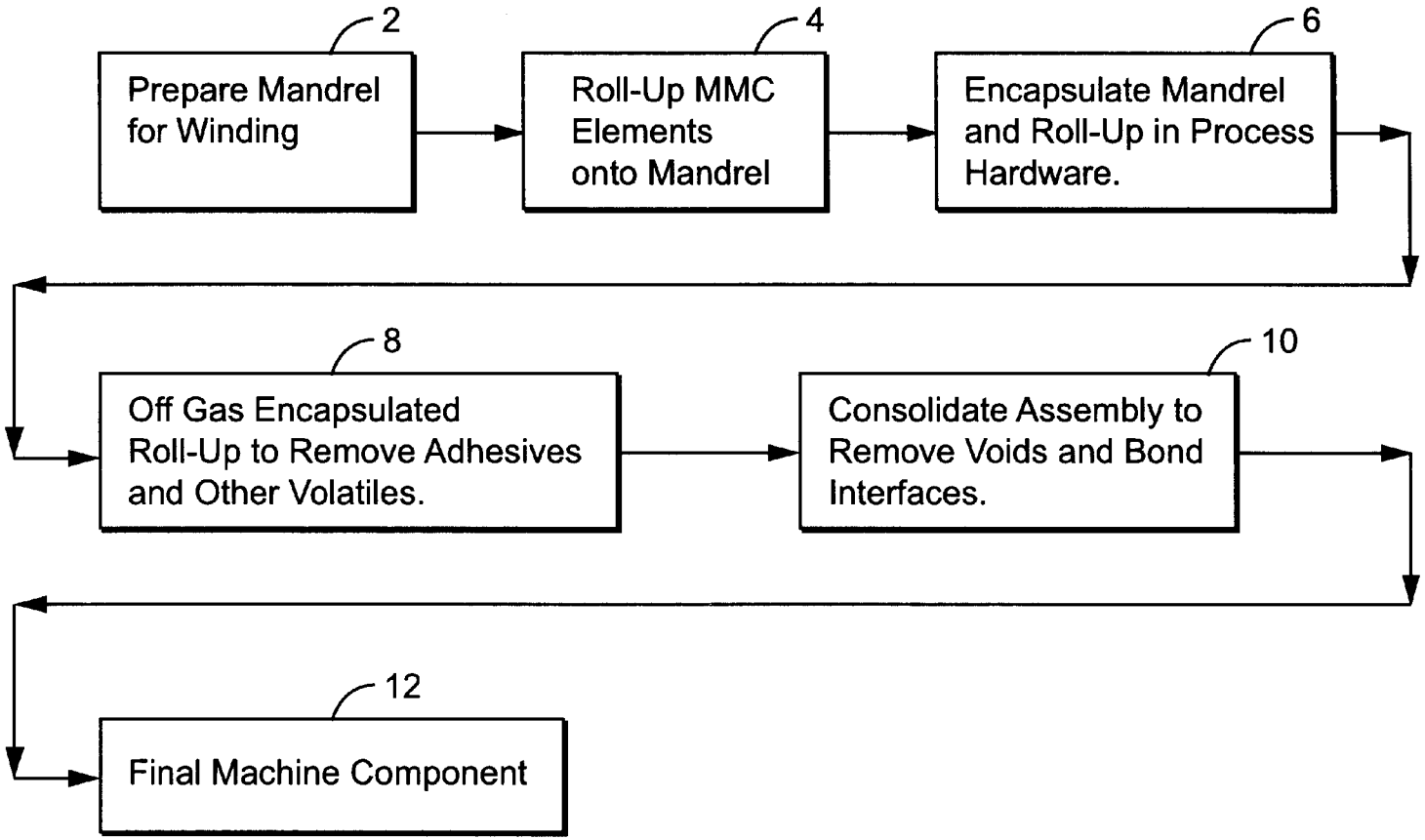
*Figure 1* *Typical Process Flow*

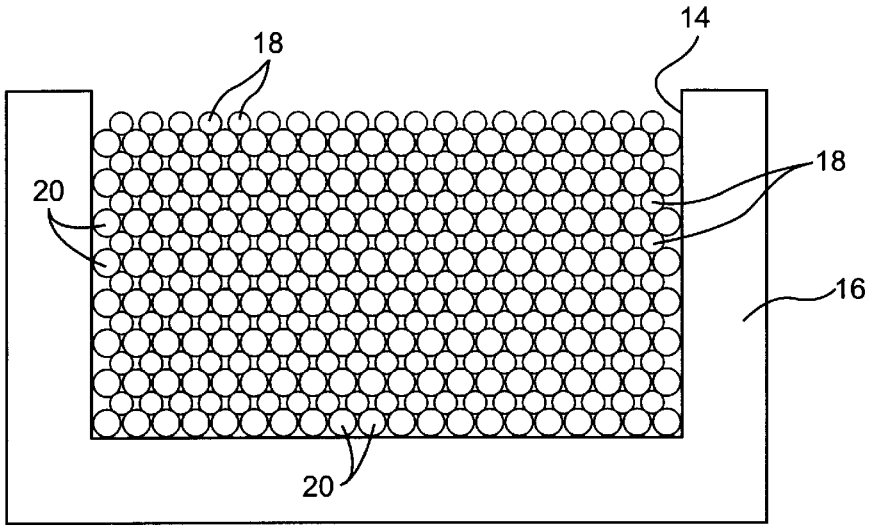
*Figure 2* *Wire/Fiber Assembly for Ring Component*
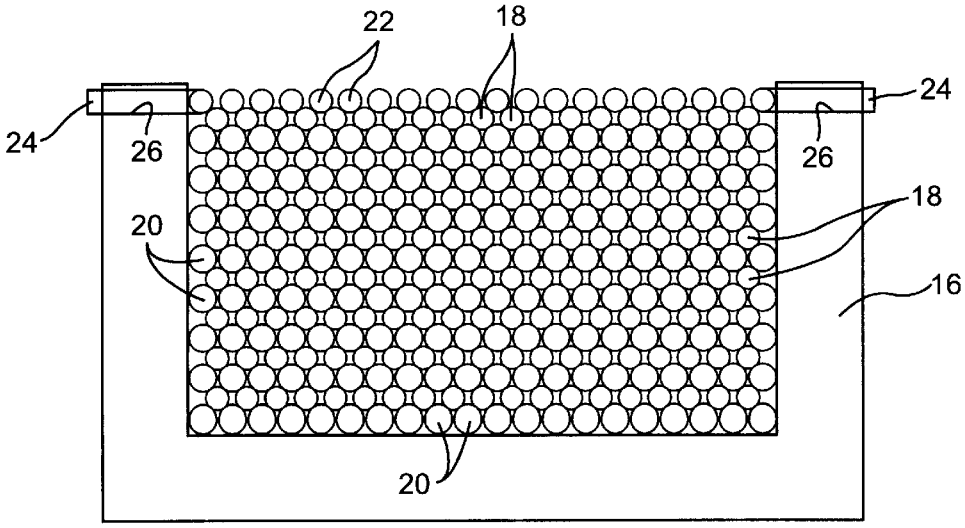
*Figure 3* *Wire Overwrap of Ring Assembly*

METHOD FOR CONTROLLING COMPOSITE PREFORM ELEMENTS DURING PROCESSING

FIELD OF THE INVENTION

The present invention relates to composite preforms used in the formation of continuous fiber/metal matrix composites, and more particularly, to a method for retaining the composite preform elements in position during processing.

BACKGROUND OF THE INVENTION

Composite preforms such as those used in the formation of continuous fiber/metal matrix composites are composed of an assembly of mono-filament fibers and a matrix metal in the form of foil, powder or wire. These assemblies may be used for the manufacture of a ring or a rod, for example. In each case, an assembly of precursor fibers and metal is rolled onto a mandrel to build up the reinforcement region. In a case of a ring, for example, this is accomplished by rolling up a collection of metal wires and fibers on an annular, recessed, substrate or mandrel to form the assembly. In the case of a rod, a pre-preg sheet is first fabricated consisting of a layer of fibers and a layer of metal wires bonded together with adhesive. This sheet is then rolled up onto a cylindrical mandrel to form the assembly.

In the case of both ring and rod assemblies, the rolled assembly must be held in place in such a way as to retain the relative positions of the fiber and metal elements throughout the fabrication process. In a case of the ring assembly, this requires holding the roll up from unwinding, and in the case of the rod assembly, this requires holding the roll-up from unwinding and accommodating shrinkage in the roll-up due to debulking which occurs in the rod roll-up during the off gas operation owing to the removal of the adhesive used to fabricate the pre-preg sheets.

Currently, the rolled assembly in organic composite fabrication is held in place through the use of an elastomeric bladder and an associated pressure differential that holds the bladder against the assembly. In the case of metal matrix composites, this processing hardware must be suitable for high temperature operations which are much higher in temperature than is suitable for the typical elastomer. Typically, therefore, the encapsulation hardware for such processing is composed of either steel or titanium metal, neither of which is elastomeric enough to be pushed against the rolled assembly by differential pressure until the process temperature and pressure have reached very high values. This results in a significant disadvantage for the reason that the assembly is in an unclamped state during most of the fabrication process which allows for unwanted movement of the metal and fiber assembly elements during processing.

Accordingly, a need has arisen for a simple and effective method for controlling the relative positions of the rolled assembly elements and clamping them in place throughout the entire fabrication process. The method of the present invention meets this need.

SUMMARY OF THE INVENTION

In accordance with the new and improved method of the present invention, the assembly of fibers and metal on the mandrel or substrate is clamped thereon and held in place during the entire fabrication process by winding over the assembly in a spiral fashion a wire formed of a suitable heat resistant metal such as a titanium. The ends of the clamping wire may be fixed by inserting them in grooves or other apertures in the mandrel or substrate, or by otherwise securing them to the mandrel or substrate. The pitch of the winding and the tension applied by the clamping wire during the spiral winding thereof is selected based on the specific roll-up assembly characteristics. In the case of a metal powder/fiber assembly, for example, the clamping wire overwrap is wound tight to itself, i.e., such that the overwrap wires are in engagement with each other. This eliminates the migration of the power from the roll-up assembly during processing. In the case of a metal wire/fiber assembly, or a metal foil/fiber assembly, the spacing between the clamping wires can be greater.

In this manner, tension on the clamping wire during winding assures intimate contact between the wire overwrap and the rolled assembly as well as establishing a certain amount of elastic compliance to the overwrap. The clamping wire overwrap may be tensioned during winding, for example, to accommodate for a predetermined diameter contraction of the roll-up assembly during processing.

BRIEF DESCRIPTION OF THE DRAWINGS

FIG. 1 is a block diagram of a typical process flow for the formation of continuous fiber/metal matrix composites made up of an assembly of fibers and a matrix metal in the form of foil, powder or wire;

FIG. 2 is a side elevational view, partly in section, of a metal wire/fiber assembly for a ring component prior to fabrication processing;

FIG. 3 is a side elevational view similar to FIG. 2 wherein the clamping wire is spirally wrapped over the metal wire/fiber assembly prior to fabrication processing;

DESCRIPTION OF THE PREFERRED EMBODIMENTS

Figure 4:
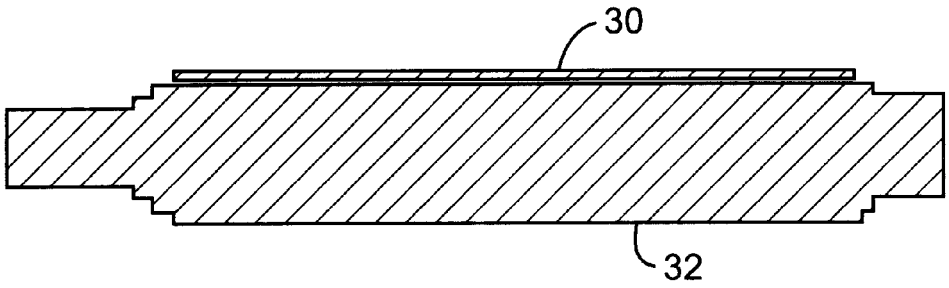
FIG. 4 is a side elevational view, partly in section, of a metal fiber pre-preg sheet assembly for a rod component.

FIG. 1 illustrates in block form a typical process flow for the formation of continuous fiber/metal matrix composites made up of an assembly of monofilament fibers and a matrix metal in the form of foil, powder or wire. In block 2, the mandrel is prepared for winding. Thereafter, the fiber and metal elements are rolled up on the mandrel (block 4), and the mandrel and rolled assembly thereon are then encapsulated in process hardware (block 6) in a manner well-known to those skilled in the art. The encapsulated rolled assembly on the mandrel is then off-gassed to remove adhesives and other volatiles (block 8), and the assembly is consolidated to remove voids and bond interfaces (block 10). Thereafter, the final reinforced component is produced (block 12).

FIG. 2 illustrates the method step in block 4 in FIG. 1 for a ring component wherein a metal wire/fiber assembly is rolled up within the annular recess 14 of a mandrel or substrate 16. The rolled assembly comprises a selected or predetermined number of alternate rows of rolled-up metal wire 18 and fiber 20 in any desired orientation. Instead of metal wire, the metal can be in the form of a foil or powder and the rolled assembly can include layers of adhesive to hold the components in place in a manner well-known to those skilled in the art.

FIG. 3 illustrates the wire overwrap of the present invention applied to the metal wire/fiber assembly of FIG. 2 in accordance with the process step of block 6 in FIG. 1. In accordance with the invention, instead of a metal bladder or the like, a metal retaining wire 22 formed of a high temperature resistant metal is spirally wound under a desired tension around the outer surface of the metal wire/fiber assembly to hold the wires and fibers in their desired positions during subsequent processing as indicated in blocks 8, 10 and 12 in FIG. 1. The metal retaining wire 22 may be formed of titanium, molybdenum, tungsten, rhenium or a titanium/niobium alloy. To hold the retaining wire in the desired tensioned position, the ends 24 thereof are inserted into grooves 26 in the mandrel or substrate 16 or are otherwise secured thereto in any suitable manner.

The size and shape of the retaining wire 22 and the spacing and tension thereof on the metal wire/fiber assembly will be determined by the specific construction and nature of the rolled assembly. For example, in the case of a metal powder/fiber assembly, the wire overwrap would be wound tight to itself, i.e., such that the clamping wires are in engagement with each other. This would eliminate the migration of the metal powder from the assembly during subsequent processing.

In the case of the metal wire/fiber assembly shown in FIGS. 2 and 3, the retaining wires 22 can be spaced apart typically 20 to 50 wires per inch for the reason that metal powder does not have to be contained. Also, in the case of a metal foil/fiber assembly the spacing between the retaining wires 22 could be even larger, e.g., five wires per inch.

FIG. 4 illustrates the method step in block 4 in FIG. 1 for a rod component wherein a metal/fiber pre-preg sheet 30 is rolled up in a desired number of layers on a mandrel 32. The pre-preg sheet 30 comprises a layer of fibers and a metal matrix layer bonded together with a suitable adhesive (not shown). The metal matrix layer may be in the form of wires, foil or powder.

Figure 5:
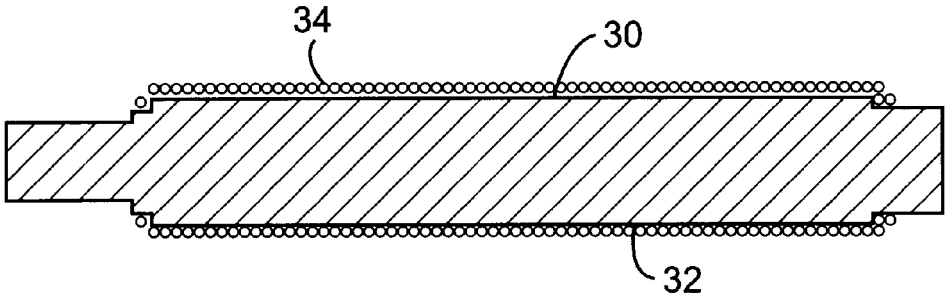
FIG. 5 is a side elevational view similar to FIG. 4 showing the clamping wire spirally wrapped over the metal fiber pre-preg sheet assembly for a rod component prior to processing.

FIG. 5 is a view similar to FIG. 4 which illustrates the metal retaining wire 34 of the present invention spirally wound under a desired tension around the outer surface of the metal/fiber pre-preg sheet 30 on the mandrel 32. To hold the retaining wire 34 in the desired tensioned position, its ends are secured to the mandrel 32 in any suitable manner (not shown).

Through the use of the metal wire overwrap of the present invention, the rolled-up metal and fiber components are maintained in the desired relative positions during the subsequent fabrication steps, such as off-gassing, heating and consolidating, and fabricating. The tension on the retaining wire 22, 34 assures intimate contact between the wire overwrap and the fiber/metal rolled assembly as well as establishing a certain amount of elastic compliance to the overwrap. In the case of a ring rollup with an outside diameter of 12 inches, for example, the metal wire overwrap could be tensioned during winding to accommodate for as much as 0.1 inches of diameter contraction during processing. The retaining wire 22, 34 becomes part of the metal structure adjacent to the metal/fiber reinforcement after processing.

It will be readily seen that the use of the metal overwrap of the present invention constitutes a significant improvement over the metal bladders previously used for encapsulating the mandrel and rolled assembly prior to the fabrication process. The metal overwrap of the present invention serves to clamp and retain the rolled up metal and fiber components in place during the entire fabrication process to ensure the formation of the desired reinforced fiber/metal matrix composite component. Also, the metal overwrap of the present invention is simple in construction, inexpensive and easy to apply over the rolled assembly in a desired manner.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for retaining fiber/metal matrix composite preforms in position during processing, comprising the steps of positioning a predetermined assembly of fibers and a matrix metal of foil, powder or wire on a mandrel, spirally winding a retaining wire of a predetermined heat resistant metal over said assembly under tension to retain said assembly in position on said mandrel, and processing said assembly surrounded by said spirally wound wire to form the fiber/metal matrix composite.

2. The method of claim 1 wherein said retaining wire is formed of titanium.

3. The method of claim 1 wherein the ends of said retaining wire are connected to said mandrel.

4. The method of claim 1 wherein said retaining wire is spirally wound under a tension such that adjacent coils of said retaining wire are in engagement with each other.

5. The method of claim 1 wherein said retaining wire is spirally wound under a tension such that adjacent coils of said retaining wire are spaced from each other.

6. The method of claim 1 wherein the retaining wire is spirally wound at a pitch, spacing and tension that are determined by the nature and construction of the rolled assembly of fibers and matrix metal.

7. The method claim 1 wherein said assembly of fibers and matrix metal is rolled on said mandrel.

8. The method of claim 1 wherein said retaining wire is formed of molybdenum.

9. The method of claim 1 wherein said retaining wire is formed of tungsten.

10. The method of claim 1 wherein said retaining wire is formed of rhenium.

11. The method of claim 1 wherein said retaining wire is formed of a titanium/niobium alloy.

* * * * *